United States Patent [19]

Flippin

[11] 4,140,425

[45] Feb. 20, 1979

[54] CABLE PLOW ASSEMBLY

[75] Inventor: James S. Flippin, Clearwater, Kans.

[73] Assignee: J. I. Case Company, Racine, Wis.

[21] Appl. No.: 800,592

[22] Filed: May 25, 1977

[51] Int. Cl.[2] ..... F16L 1/02

[52] U.S. Cl. ..... 405/181; 172/40; 405/182

[58] Field of Search ..... 61/72.5, 72.6, 72.7, 61/105; 37/98; 172/40

[56] References Cited

U.S. PATENT DOCUMENTS

| | | | |
|---|---|---|---|
| 2,663,515 | 12/1953 | Kinsinger | 61/72.6 X |
| 2,909,134 | 10/1959 | Kniefel | 61/72.6 |
| 3,354,660 | 11/1967 | Vaughan | 61/72.6 X |
| 3,514,960 | 6/1970 | Howard | 61/72.6 |
| 3,515,222 | 6/1970 | Kant | 61/72.6 X |
| 3,618,237 | 11/1971 | Davis | 61/72.6 X |
| 3,747,357 | 7/1973 | Erickson et al. | 61/72.6 |
| 3,935,712 | 2/1976 | Erickson et al. | 61/72.6 |
| 4,011,727 | 3/1977 | Suzuki et al. | 61/72.6 X |

*Primary Examiner*—Mervin Stein
*Assistant Examiner*—David H. Corbin
*Attorney, Agent, or Firm*—Cullen, Sloman, Cantor, Grauer, Scott & Rutherford

[57] ABSTRACT

The disclosed vibratory cable plow has a generally horizontal boom supported on transverse horizontal and vertical pivots and a trailer supported on the boom by a vertical pivot. A plow blade is supported on a vibration isolating frame beneath the trailer and the rear of the assembly is supported on wheels which are pivoted by piston-cylinders to control the depth of penetration of the plow blade. The disclosed plow assembly provides remote steering, blade pitch and depth adjustment and the entire assembly may be raised by piston-cylinders, about the transverse horizontal pivot, for transport.

4 Claims, 2 Drawing Figures

CABLE PLOW ASSEMBLY

FIELD OF THE INVENTION

The present invention relates to plow assemblies for laying flexible cable, pipe and the like underground in the slot cut by the plow. The cable plow assembly of this invention is particularly although not exclusively adapted for relatively large cable plows having remote steering and plow blade adjustment.

U.S. Pat. Nos. 3,363,423 and 3,618,237 of Davis assigned to the assignee of the instant application disclose improvements in vibratory cable laying plows having oppositely rotating eccentric weight vibrators transmitting vertical vibration to a plow blade and a plow frame assembly which isolates the vibration from the prime mover. The frame assembly is relatively simple and provides several advantages over the prior art. The cable plows disclosed in the Davis' patents do not however have remote steering or the improvements disclosed herein.

Relatively large cable plows having remote steering control are also available commercially as disclosed in U.S. Pat. No. 3,747,357. These larger cable plows however have several disadvantages. The control is relatively complex, yet provides only limited adjustment. The cable plow of the present invention provides remote independent steering of the cable plow, remote adjustment of the depth of penetration and pitch of the cable plow blade and the entire assembly may be raised for transport.

SUMMARY OF THE INVENTION

The plow assembly of this invention may be used for laying flexible cable, conduit and pipe underground in the slot cut by the plow. Any suitable prime mover may be utilized, such as a tractor or bulldozer. The plow assembly includes a trailing, generally horizontal boom assembly supported on the rear of the prime mover on transverse horizontal and vertical pivots. In the preferred embodiment, the boom assembly includes a generally horizontal boom supported on the horizontal pivot and a trailer supported on the rear of the boom by a vertical pivot. The plow frame assembly including the plow blade is supported by and beneath the boom assembly, preferably beneath the trailer. A ground traversing wheel supports the rear of the boom assembly, rearwardly of the plow blade and a generally vertically extensible piston-cylinder is connected between the boom assembly and the wheel for raising and lowering the rear of the boom assembly and adjusting the depth of penetration of the blade.

In the preferred embodiment, the wheel is supported on a pivot strut pivotally connected at opposed ends to the wheel axle and the trailer. The piston-cylinder is pivotally connected above the strut at one end and the opposed end is connected to the wheel axle. The wheel is thus rotated about the pivot axis of the strut to the trailer to adjust the depth of penetration of the blade. In the disclosed embodiment, the trailer is generally U-shaped in top elevation having a pair of rearwardly extending arms and each arm is supported by an independently extensible piston-cylinder, permitting adjustment of the tilt angle of the boom assembly. This adjustment may be particularly important in rough uneven terrain. The entire boom assembly may also be raised and lowered by piston-cylinders interconnected between the prime mover and the boom above the horizontal pivot axis. In the preferred embodiment, a U-shaped yoke is pivotally connected at opposed ends on horizontal pivot axes to the prime mover. The lift-cylinders are connected between the prime mover and the top of the U-shaped yoke. The boom is then supported on a vertical pivot in the yoke and piston-cylinders are connected between the yoke and the boom permitting remote steering of the rear of the yoke about the vertical pivot. The pitch of the blade is controlled by piston-cylinders interconnected between the blade and the frame support.

The blade is thus remotely steered and controlled by piston-cylinders providing complete and accurate adjustment of the blade. Other advantages and meritorious features of the present invention will be more fully understood from the following description of the preferred embodiments, the appended Claims and the drawings, a brief description of which follows.

DESCRIPTION OF THE PREFERRED EMBODIMENTS

Figure 1:
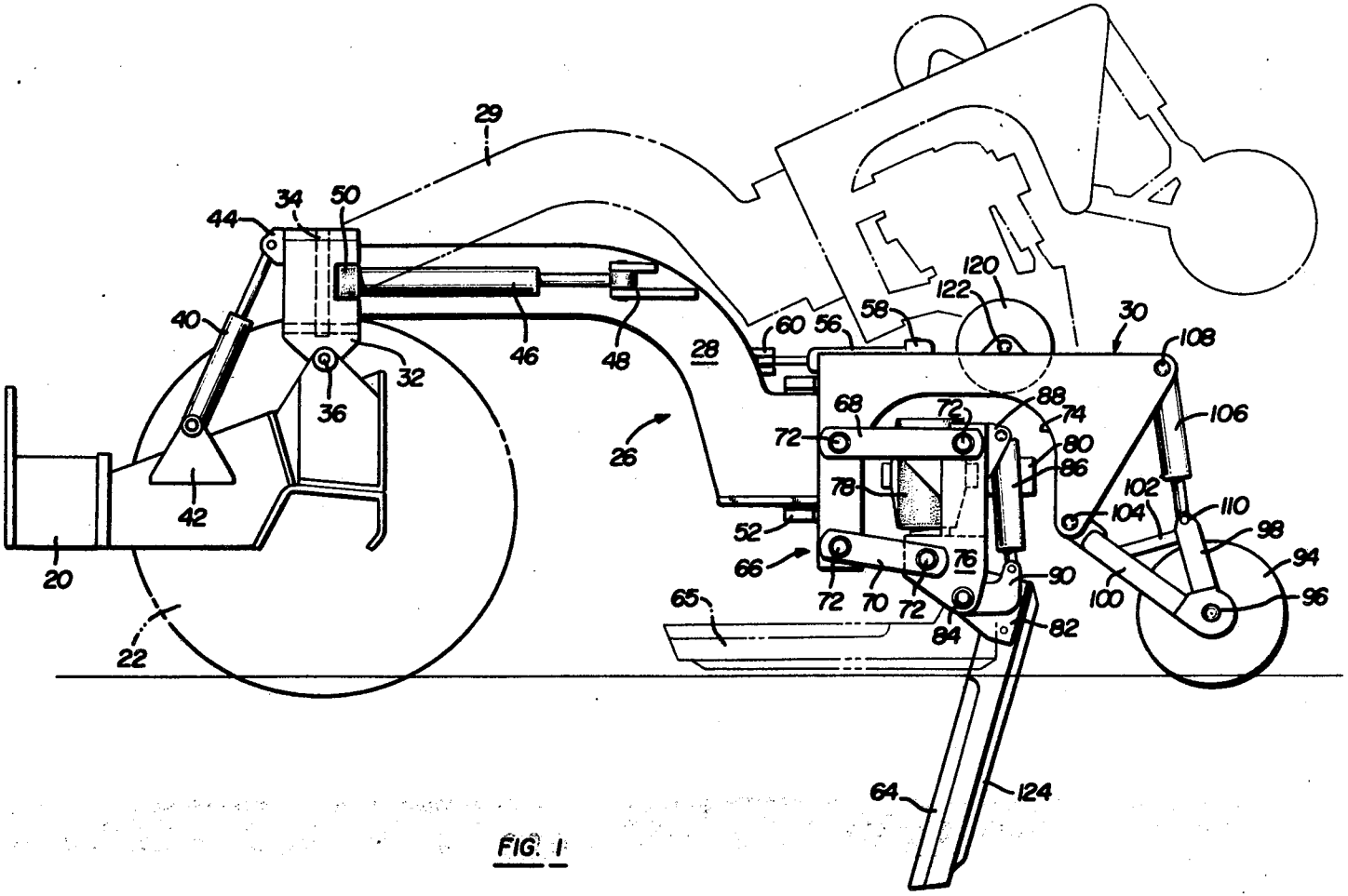
FIG. 1 is a side elevation of one embodiment of the cable plow assembly of this invention.

As described above, the plow assembly of this invention may be used with any prime mover, however the disclosed embodiment of the plow assembly is particularly adapted for relatively large cable laying plow apparatus requiring remote steering and control of the plow blade. In such applications, a vibrator is preferably used to reduce the force required to pull the blade through the earth. It will be understood however that the various improvements disclosed herein may be utilized separately, including smaller cable plow applications.

The prime mover in the disclosed embodiment of the cable plow assembly is a four wheeled tractor 20. It will be understood that the prime mover is not part of the invention disclosed herein and therefore only the rear portion of the tractor including the rear wheels 22 and the wheel axle 24 are shown. The details of the tractor therefore need not be disclosed or described.

As described, the cable plow assembly of this invention includes a boom assembly 26 including a generally horizontal boom 28 and a trailer portion 30. The boom assembly is supported on the prime mover by a universal yoke which permits raising and lowering the boom assembly about a horizontal axis and transverse steering of the assembly about a vertical axis. The yoke is box-shaped having top, bottom and side walls. As shown, a vertical pivot pin 34 is secured through the boom 28 to the top and bottom walls of the yoke, permitting the boom assembly to be laterally steered as shown at 27 in FIG. 2. The side walls of the universal yoke include downwardly extending ears which receive a horizontal pivot pin 36, permitting the boom assembly to be raised and lowered about a horizontal axis as shown at 29 in FIG. 1.

The boom assembly is raised and lowered about horizontal pivot 36 by a pair of lift piston-cylinders 40. The cylinder portions are pivotally connected to the tractor by brackets 42 and the rod portions are pivotally connected to the universal yoke by brackets 44. The lift piston-cylinders 40 are simultaneously retracted to lift the boom assembly as shown at 29 in FIG. 1 or simultaneously extended to lower the boom as shown at 26. The boom assembly may be steered about vertical pivot 34 by extending boom steerage piston-cylinder 46 and retracting the opposed piston-cylinder. The rod portion of piston-cylider 46 is pivotally connected to a bracket 48 on the boom and the cylinder portion is pivotally connected to the universal yoke at 50. It will be understood that the piston-cylinders utilized in the control mechanism may be conventional hydraulic cylinders each of which include control lines on opposite sides of the piston head. In the preferred embodiment, the control lines extend to the operator position of the prime mover, permitting control of the cable plow from the prime mover. The details however of the hydraulic circuit may be conventional and therefore are not shown or described.

The trailer portion 30 is pivotally supported on the boom by a vertical pivot pin 54 which extends through ears 52 on the trailer and the rearward end of the boom 28.

The trailer 30 may be independently steered by trailer steering piston-cylinders 56. The cylinder portions are pivotally connected to brackets 58 on the trailer and the piston rod portions are pivotally connected to bracket 60 on the boom. One cylinder 56 is extended while the opposed cylinder is retracted to steer the trailer. One advantage of independent steering is shown in phantom in FIG. 2. As shown, the upper piston-cylinder 46 in FIG. 2 has been retracted and the lower piston-cylinder has been extended to turn the boom in a counterclockwise direction about vertical pivot 34. Simultaneously, the top piston-cylinder 56 in FIG. 2 has been extend and the lower piston-cylinder has been retracted to guide the trailer in a parallel path. This type of control is very important where the terrain receiving the cable is unsuitable for the tractor or where the cable is to be laid up to a pole, such as a telephone pole.

In the preferred embodiment, the cable plow blade 64 is preferably supported on a vibration isolating frame beneath the boom assembly. In the disclosed embodiment, the plow is supported on plow frame assembly 66 in a C-shaped opening 74 in trailer 30 as shown in FIG. 1. The plow frame is comprised of two pairs of upper links 68, two pairs of lower links 70 and J-shaped end brackets 76 interconnected by resilient vibration isolating torsion bushing 72. The details of the frame assembly are not disclosed herein because the details may be similar to U.S. Pat. No. 3,618,237 of Davis assigned to the assignee of the instant application. As described in the Davis patent, the vibrator 78 may be a double weight vibrator having two eccentrically mounted weights rotating in opposite direction to provide substantially vertical vibration. The vibrator is mounted on a platform on the J-brackets 76 to impart vertical vibration to the blade 64. The vibrator is driven by a suitable motor 80 which may be connected directly to the drive shaft of the vibrator 78.

The plow blade 64 is mounted adjacent the center or longitudinal axis of the boom on a bracket comprised of plates 82. The plates are mounted on a cylinder 84 which extends through the J-bracket 76 as shown in FIG. 1. A cylindrical rod way also may be used. The plow blade 64 in the disclosed embodiment may be pitched about the axis of cylinder 84 to adjust the pitch angle for soil conditions or the blade may be raised to a horizontal position for transport as shown in phantom at 65 in FIG. 1. The blade is pitched by pitch piston-cylinders 86; one piston-cylinder on each side of the frame. The cylinder portion is pivotally supported on bracket 88 on J-bracket 76 and the rod portion is pivotally connected between a pair of L-shaped brackets 90. The L-brackets are connected to cylinder 84. Thus, the blade may be pitched by simultaneously extending piston-cylinders 86, rotating L-brackets 90 and cylinder 84 in a clockwise direction, rotating bracket 82 and blade 64 in the same direction.

Figure 2:
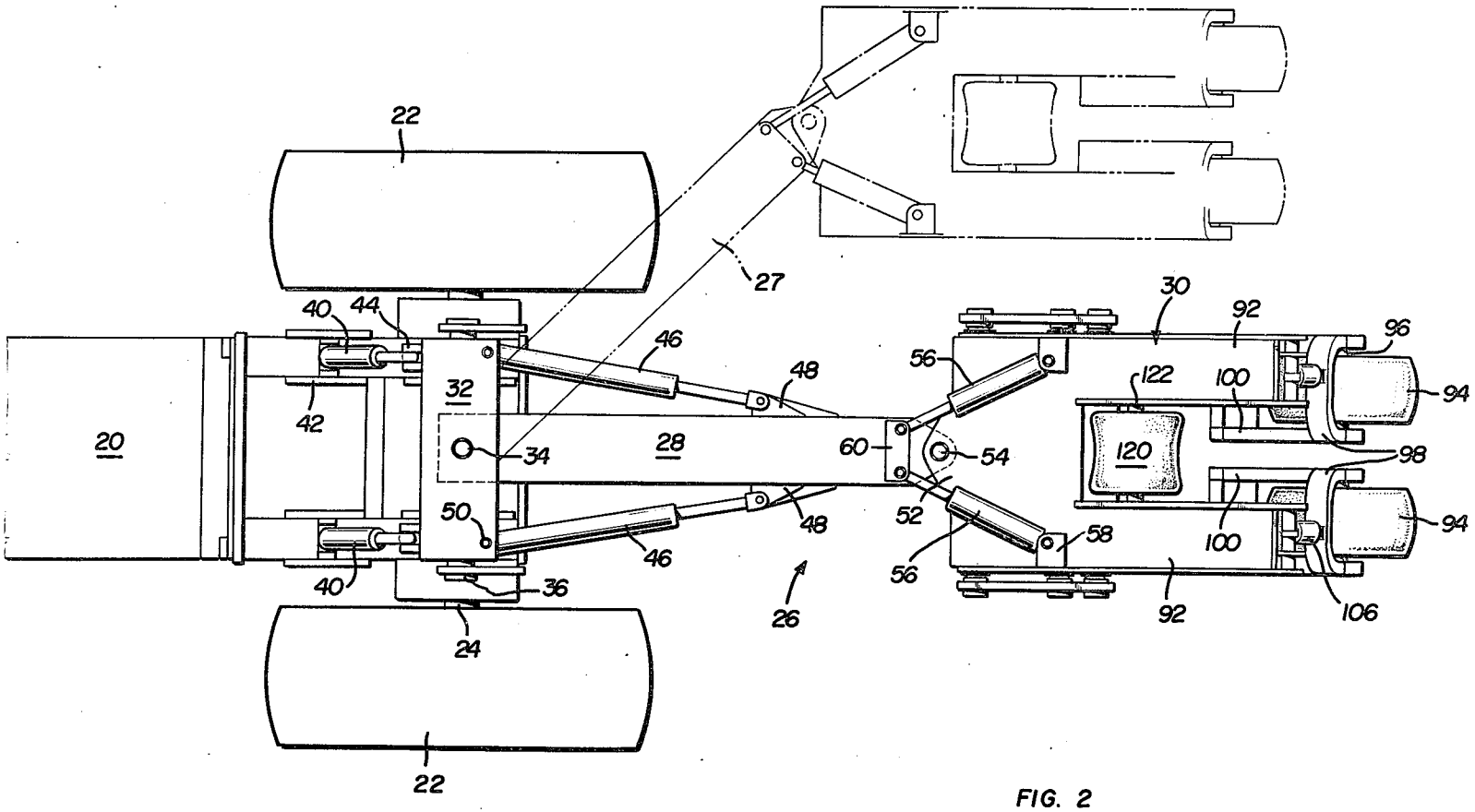
FIG. 2 is a top elevation of the cable plow assembly shown in FIG. 1.

As shown in FIG. 2, the trailer 30 is generally U-shaped in the top view having a pir of rearwardly extending arms 92. A wheel 94 supports each of the arms for adjustment of the tilt angle of the boom assembly and to adjust the cutting depth of the blade 64. Each of the wheels includes an axle 96 which is rotatably supported in a U-shaped yoke 98 having integral box-shaped struts 100. A reenforcing strut 102 is connected between the yoke 98 and the strut 100 as shown in FIG. 1 to form a triangular support for the trailer. The strut 100 is pivotally connected at 104 to the trailer. Piston-cylinders 106 are connected between the trailer and the bite of the U-shaped yokes 98. The cylinder portion is pivotally connected to the trailer at 108 and the rod portion is connected to the bite of the U-shaped yoke at 110. Extension and retraction of the piston-cylinders 106 will thus cause the triangular frame assembly to rotate about pivot axes 104, raising and lowering the rear portion of the boom assembly. In the preferred embodiment, the pistons 106 are independently extensible and retractable. Where the pistons 106 are simultaneously extended or retracted, the rear portion of the boom assembly is raised and lowered to adjust the cutting depth of the plow blade 64. Where one piston is extended and the opposed piston is retracted, the tilt angle may be corrected to correspond to the tractor and accomodate variations in the tilt of the terrain.

In operation, flexible cable, conduit or the like may be fed from a reel supported on the tractor over the boom 28 and into the space between the arms 92 to the plow blade. In the disclosed embodiment, a cable cushion 120 in the form of a ribbed tread high floation tire is rotatably supported on anxle 122 between the arms 92 as best shown in FIG. 2. Cable or the like is then threaded over the cable cushion 120 into the cable guide 124 on the trailing or rearward edge of the blade 64. As described above, the vibrator 78 imparts a generally vertical vibration to the blade, reducing the draw bar pull and limiting disturbance of the soil. The vibration is isolated from the prime mover 20 by the vibration isolating plow frame assembly 66. The depth of blade penetration may be adjusted by pistons 106 and the pitch angle of the blade may be adjusted by piston-cylinders 86.

It can be seen from the above description of the operation of the cable plow of this invention that several improvements have been made over the prior art. The plow blade 64 may be independently steered by operation of the piston-cylinders 46 and 56. The entire boom assembly may be raised and lowered for transport or to raise the blade 64 out of the ground by simultaneously retracting piston-cylinders 40. The blade pitch angle may be adjusted by operation of piston-cylinders 86 and the depth of penetration of the blade may be independently adjusted by operation of piston-cylinders 106. It will be understood however that the disclosed controls may be utilized independently in any particular application and therefore the invention disclosed herein is not dependent upon utilization of all of the disclosed controls. Further various modifications may be made to the cable plow assembly of this invention without departing from the perview of the Claims, which follow.

I claim:

1. A plow assembly for laying an elongated flexible element such as a cable in the slot cut by the plow in the ground, comprising:

a prime mover, a trailing generally horizontal boom assembly having a forward portion supported on the rear of said prime mover on a transverse horizontal pivot, a plow frame assembly supported by and beneath said boom assembly having a ground penetrating blade a trailing ground traversing wheel having a transverse axle connected to said boom by a structural member, said wheel supporting the rear portion of said boom assembly, rearward of said plow blade, said boom assembly includes a generally vertical yoke supported on said horizontal pivot, a piston-cylinder interconnected between said prime mover and said yoke of said boom assembly, said piston-cylinder extending in an inclined upward angle relative to vertical for lifting the boom and plow assembly about said horizontal pivot, said boom assembly comprises a generally horizontal boom supported on said transverse horizontal pivot on said prime mover and a downwardly opening U-shaped trailer in side elevation pivotally supported on the rear of said boom on a vertical pivot, said rear trailer being independently steerable, and said plow frame supported within said U-shaped trailer, said plow frame mounted in a cantilevered fashion to one of the downwardly extending legs of said U-shaped trailer for vertical vibratory motion, and said plow blade is pivotally supported on said plow frame and said plow frame assembly includes an extensible piston-cylinder pivotally connected between said frame assembly above said blade and said plow blade, said piston-cylinder extensible to rotate said blade forwardly toward the prime mover to a generally horizontal position for transport.

2. The plow assembly defined in claim 1, characterized in that said plow frame assembly includes a vibrator and generally horizontal frame members supported within said U-shaped opening by vibration isolating torsion bearings.

3. The plow assembly defined in claim 1, characterized in that said wheel is mounted on a horizontal axle generally perpendicular to the longitudinal axis of said boom, the support for said wheel pivotally mounted to said boom and including a downwardly opening U-shaped yoke rotatably receiving said wheel axle therein, a strut pivotally connected at opposed ends to said wheel axle and said boom assembly and a piston-cylinder interconnected between the bite of said U-shaped yoke and said frame above said yoke, said piston-cylinder extensible and retractable to pivot said wheel about the pivotal connection between said strut and said boom assembly, raising and lowering said plow blade.

4. The plow assembly defined in claim 1, wherein said trailer having two laterally spaced rearwardly extending arms, each arm having a supporting wheel and a cylindrical resilient cable cushion rotatably supported between said arms on a transverse horizontal axis.

* * * * *